US008985038B2

(12) United States Patent
Flygare et al.

(10) Patent No.: US 8,985,038 B2
(45) Date of Patent: Mar. 24, 2015

(54) FEEDER MOVEMENT COMPENSATION

(75) Inventors: Anders Flygare, Jönköping (SE); Jonas Bardh, Jönköping (SE); Gunnar Johansson, Huskvarna (SE)

(73) Assignee: VSM Group AB, Huskvarna (SE)

( * ) Notice: Subject to any disclaimer, the term of this patent is extended or adjusted under 35 U.S.C. 154(b) by 637 days.

(21) Appl. No.: 13/156,347

(22) Filed: Jun. 9, 2011

(65) Prior Publication Data

US 2011/0303138 A1 Dec. 15, 2011

Related U.S. Application Data

(60) Provisional application No. 61/352,827, filed on Jun. 9, 2010.

(51) Int. Cl.
*D05B 19/00* (2006.01)
*D05B 27/06* (2006.01)
*D05B 19/16* (2006.01)

(52) U.S. Cl.
CPC ..... *D05B 27/06* (2013.01); *D05B 19/16* (2013.01)
USPC ..... 112/470.01; 112/475.17; 700/136

(58) Field of Classification Search
USPC ..... 112/102.5, 470.01, 470.03, 470.04, 112/475.17; 700/136–138
See application file for complete search history.

(56) References Cited

U.S. PATENT DOCUMENTS 3,570,426 A 3/1971 Kunes
3,585,950 A 6/1971 Ito
3,613,608 A 10/1971 Hinerfeld et al.
3,613,610 A 10/1971 Hinerfeld et al.
3,693,561 A 9/1972 Hrinko, Jr. et al.
3,712,254 A 1/1973 Beamish et al.
3,727,567 A 4/1973 Beazley
3,799,087 A 3/1974 Beamish et al.
3,815,531 A 6/1974 Wurst et al.

(Continued)

FOREIGN PATENT DOCUMENTS

CA 1081544 A1 7/1980
CA 2515406 A1 8/2004

(Continued)

*Primary Examiner* — Nathan Durham
(74) *Attorney, Agent, or Firm* — Lando & Anastasi, LLP

(57) ABSTRACT

A feeder movement compensation algorithm for use within a processor controlled sewing machine. The sewing machine configured with a reciprocating needle and thread, and including a stitch plate upon which fabric to be sewn is positioned beneath the needle and thread. The machine also includes a feeder mechanism driving a feed dog thru a movement. The feed dog movement pushes the fabric along the stitch plate and the reciprocating needle and thread form stitches in the fabric. During the stitch cycle, the feed dog movement completes at least one feeder stroke. The feeder stroke includes a portion of the feed dog extending above the stitch plate and moving along the direction of feed. The feeder stroke thus pushes the fabric along the stitch plate. The compensation algorithm calculates a theoretical feeder stroke length based upon a desired stitch. The compensation algorithm then calculates a modified feeder stroke length using the theoretical feeder stroke length and at least one feeder calibration data element. The modified feeder stroke length is then performed by the feed dog during the stitch cycle to form the stitch.

4 Claims, 7 Drawing Sheets

(56) References Cited

U.S. PATENT DOCUMENTS 3,818,849 A 6/1974 Maddox, Jr.
3,904,890 A 9/1975 Wenrich et al.
3,967,566 A 7/1976 Spiegel et al.
4,051,794 A 10/1977 Herzer et al.
4,073,247 A 2/1978 Cunningham et al.
4,092,937 A 6/1978 Landau, Jr. et al.
4,100,865 A 7/1978 Landau, Jr. et al.
4,104,976 A 8/1978 Landau, Jr. et al.
4,108,090 A 8/1978 Landau, Jr. et al.
4,116,145 A 9/1978 Nicolay
4,133,275 A 1/1979 Herzer et al.
4,154,179 A 5/1979 Arnold
4,160,422 A 7/1979 Barber et al.
4,181,085 A 1/1980 Conner, Jr.
4,185,575 A 1/1980 Brown et al.
4,195,582 A 4/1980 Novick et al.
4,214,540 A 7/1980 Cook
4,221,176 A 9/1980 Besore et al.
4,351,254 A 9/1982 Brown
4,352,334 A 10/1982 Childs et al.
4,359,008 A 11/1982 Newman
4,365,565 A 12/1982 Kawai et al.
4,373,458 A 2/1983 Dorosz et al.
4,373,459 A 2/1983 Dunn et al.
4,391,215 A 7/1983 Sansone
4,393,343 A 7/1983 Angersbach et al.
4,412,498 A 11/1983 Scholl
4,457,246 A 7/1984 Hanyu et al.
4,503,794 A 3/1985 Ishihara et al.
4,507,596 A 3/1985 Angersbach et al.
4,509,443 A 4/1985 Martell et al.
4,513,676 A 4/1985 Martell et al.
4,519,331 A 5/1985 Kosrow et al.
4,526,114 A 7/1985 Martell et al.
4,526,116 A 7/1985 Ma/ nnel
4,555,997 A 12/1985 Tancs
4,557,207 A 12/1985 Turner et al.
4,563,964 A 1/1986 Sjodin
4,612,867 A * 9/1986 Rosch et al. ..... 112/470.03
4,622,907 A 11/1986 Kimura
4,648,337 A 3/1987 Mall
4,682,554 A 7/1987 Goto et al.
4,686,917 A 8/1987 Braun
4,706,584 A 11/1987 Senda et al.
4,726,307 A 2/1988 Yamauchi
4,726,309 A 2/1988 Popp
4,742,786 A 5/1988 Hashimoto et al.
4,748,920 A 6/1988 Stutznacker
4,757,773 A 7/1988 Nomura et al.
4,777,896 A * 10/1988 Nomura ..... 112/470.03
4,781,130 A 11/1988 Badowski
4,794,875 A 1/1989 Noguchi et al.
4,803,937 A 2/1989 Hiramatsu et al.
4,815,406 A 3/1989 Brown et al.
4,834,008 A 5/1989 Sadeh et al.
4,841,891 A 6/1989 Hashimoto et al.
4,849,902 A 7/1989 Yokoe et al.
4,860,678 A 8/1989 Skogward
4,867,082 A 9/1989 Sabbioni et al.
4,867,087 A 9/1989 Suzuki et al.
4,901,660 A * 2/1990 Takeuchi et al. ..... 112/470.03
4,932,343 A 6/1990 Mardix et al.
4,982,677 A 1/1991 Nomura et al.
4,995,328 A 2/1991 Tanaka
5,000,105 A 3/1991 Tanaka
5,012,752 A 5/1991 Murata et al.
5,018,466 A 5/1991 Hasegawa
5,095,835 A 3/1992 Jernigan et al.
5,138,962 A 8/1992 Klundt
5,146,862 A 9/1992 Sato et al.
5,156,106 A 10/1992 Suzuki et al.
5,156,107 A 10/1992 Kyuno et al.
5,184,560 A 2/1993 Asano
5,270,939 A 12/1993 Goldberg et al.
5,303,665 A 4/1994 Hausammann
5,319,565 A 6/1994 Hausammann et al.
5,323,722 A 6/1994 Goto et al.
5,347,940 A 9/1994 Hori et al.
5,389,868 A 2/1995 Mikami et al.
5,410,976 A 5/1995 Matsubara
5,474,005 A 12/1995 Yamauchi et al.
5,477,795 A 12/1995 Nakayama et al.
5,537,939 A 7/1996 Horton
5,537,946 A 7/1996 Sadeh et al.
5,562,059 A 10/1996 Yamauchi et al.
5,571,240 A 11/1996 Yamauchi et al.
5,588,383 A 12/1996 Davis et al.
5,592,891 A 1/1997 Muto
5,603,272 A 2/1997 Takahashi et al.
5,653,186 A 8/1997 Yamauchi et al.
5,701,830 A 12/1997 Muto
5,740,055 A 4/1998 Iwata
5,755,240 A 5/1998 Schonborn
5,791,270 A 8/1998 Mori
5,911,182 A 6/1999 Uyama et al.
5,924,372 A 7/1999 Okuda et al.
5,974,997 A 11/1999 Amburgey
6,032,595 A 3/2000 Okuyama
6,131,526 A 10/2000 Iida et al.
6,135,038 A 10/2000 Okamoto
6,189,989 B1 2/2001 Hirabayashi et al.
6,202,001 B1 3/2001 Muto
6,209,468 B1 4/2001 Marcangelo et al.
6,293,210 B1 9/2001 Freeman et al.
6,321,670 B1 11/2001 Tomita et al.
6,381,818 B1 5/2002 Freeman et al.
6,450,110 B1 * 9/2002 Bruhl et al. ..... 112/470.01
6,718,893 B1 * 4/2004 Kong ..... 112/102.5
6,718,895 B1 4/2004 Fortuna
6,729,255 B2 5/2004 Ton et al.
6,732,668 B2 5/2004 Zesch et al.
6,776,112 B2 * 8/2004 Bruehl et al. ..... 112/470.01
6,823,807 B2 11/2004 Zesch et al.
6,871,605 B1 3/2005 Zesch et al.
6,871,606 B2 * 3/2005 Schweizer ..... 112/102.5
6,883,446 B2 4/2005 Koerner
6,883,449 B2 4/2005 Burrell et al.
6,963,790 B2 11/2005 Mizuno et al.
6,983,192 B2 1/2006 Block et al.
6,994,042 B2 * 2/2006 Schweizer ..... 112/470.03
7,210,417 B2 5/2007 Koerner
7,212,880 B2 5/2007 Mizuno et al.
7,240,628 B2 7/2007 Friman et al.
7,308,333 B2 12/2007 Kern et al.
7,412,936 B2 8/2008 Price et al.
7,460,925 B2 12/2008 Noguchi
7,793,602 B2 9/2010 Koemer
7,814,832 B2 10/2010 Franz
8,261,679 B2 9/2012 Ihira et al.
8,387,547 B2 3/2013 Bardh et al.
2002/0020334 A1 * 2/2002 Bruhl et al. ..... 112/470.01
2002/0043202 A1 4/2002 Freeman et al.
2003/0140829 A1 7/2003 Zesch et al.
2003/0140831 A1 7/2003 Zesch et al.
2003/0140832 A1 7/2003 Ton et al.
2004/0099191 A1 * 5/2004 Bruehl et al. ..... 112/275
2004/0210336 A1 10/2004 Block et al.
2005/0016428 A1 1/2005 Koerner
2006/0064195 A1 3/2006 Kern et al.
2006/0213413 A1 9/2006 Koerner
2007/0204781 A1 9/2007 Noguchi
2007/0245940 A1 10/2007 Wahlstrom
2007/0256619 A1 11/2007 Koemer
2010/0224111 A1 9/2010 Ihira et al.
2011/0005441 A1 1/2011 Roche
2011/0041746 A1 2/2011 Eklund et al.
2011/0146553 A1 6/2011 Wilhelmsson et al.
2011/0168070 A1 7/2011 Lanquist
2012/0060733 A1 3/2012 Maki et al.
2012/0060734 A1 3/2012 Yamanashi et al.
2012/0234222 A1 9/2012 Naka

(56) References Cited

U.S. PATENT DOCUMENTS

| | | | |
|---|---|---|---|
| 2013/0014682 | A1 | 1/2013 | Brindzik |
| 2013/0042797 | A1 | 2/2013 | Bondesson et al. |

FOREIGN PATENT DOCUMENTS

| | | | |
|---|---|---|---|
| DE | 102007001073 | A1 | 8/2007 |
| EP | 77788 | A1 | 5/1983 |
| EP | 103364 | A2 | 3/1984 |
| EP | 117713 | A1 | 9/1984 |
| EP | 124211 | A1 | 11/1984 |
| EP | 366140 | A1 | 5/1990 |
| EP | 515131 | A1 | 11/1992 |
| EP | 564771 | A2 | 10/1993 |
| EP | 857228 | A1 | 8/1998 |
| EP | 1184502 | A1 | 3/2002 |
| EP | 1777331 | A1 | 4/2007 |
| EP | 2226419 | A1 | 9/2010 |
| GB | 1320764 | A | 6/1973 |
| GB | 1349994 | A | 4/1974 |
| GB | 1375540 | A | 11/1974 |
| GB | 1393294 | A | 5/1975 |
| GB | 1440350 | A | 6/1976 |
| GB | 1475791 | A | 6/1977 |
| GB | 1526209 | A | 9/1978 |
| GB | 1547931 | A | 7/1979 |
| GB | 1547932 | A | 7/1979 |
| GB | 1547933 | A | 7/1979 |
| GB | 1547934 | A | 7/1979 |
| GB | 1568486 | A | 5/1980 |
| GB | 1570241 | A | 6/1980 |
| GB | 1570242 | A | 6/1980 |
| GB | 1570243 | A | 6/1980 |
| GB | 1570244 | A | 6/1980 |
| GB | 1570245 | A | 6/1980 |
| GB | 1571736 | A | 7/1980 |
| GB | 2043124 | A | 10/1980 |
| GB | 1583629 | A | 1/1981 |
| GB | 2157723 | A | 10/1985 |
| GB | 2168085 | A | 6/1986 |
| GB | 2177520 | A | 1/1987 |
| GB | 2204604 | A | 11/1988 |
| JP | 1212591 | A | 8/1989 |
| JP | 02055080 | A | 2/1990 |
| JP | 6304359 | A | 11/1994 |
| JP | 2000167277 | A | 6/2000 |
| JP | 2000342869 | A | 12/2000 |
| JP | 2009011594 | A | 1/2009 |
| JP | 2009233435 | A | 10/2009 |
| JP | 2010185151 | A | 8/2010 |
| KR | 198800714 | B1 | 4/1988 |
| WO | 8901067 | A1 | 2/1989 |
| WO | 9715708 | A1 | 5/1997 |
| WO | 0104405 | A1 | 1/2001 |
| WO | 2004072349 | A2 | 8/2004 |
| WO | 2006071786 | A2 | 7/2006 |
| WO | 2007143062 | A2 | 12/2007 |
| WO | 2010144013 | A1 | 12/2010 |

* cited by examiner

FEEDER MOVEMENT COMPENSATION

CROSS-REFERENCE TO RELATED APPLICATION

This application claims the benefit of U.S. Provisional Application Ser. No. 61/352,827, filed on Jun. 9, 2010, the entirety of which is hereby incorporated herein by reference.

BACKGROUND OF THE INVENTION

1. Field of the Invention

The present invention generally relates to an algorithm and method to modify the feeder movement of a sewing machine. More particularly, the present invention relates to an algorithm and method to modify the feeder movement of a sewing machine based on calibration data to achieve a desired stitch over the configuration and operating range of the machine.

2. Description of the Related Art

A modern sewing machine is able to produce a variety of stitches and seams on demand. During normal operation, the feeding of the fabric into the machine is controlled by a feed dog which is driven by a mechanism. The fabric is moved beneath the sewing needle by the movement of the feed dog.

The sewing machine includes a selection of stitches and seams. A seam is an entity composed of a number of stitches. Advanced sewing machines provide tools for creating new stitch elements by combining existing stitches, or seams. Data for each individual stitch, or seam can be reproduced as a graphic representation on a display, which may be integrated with the sewing machine.

The sewing machine is provided with a processor, a control program, and a memory. The control program may be integral with the processor or stored in memory. The memory is accessible by the processor and may either be accommodated within the machine or may be external. Data for each individual stitch, or seam, is stored in a database within the memory. A display may be provided upon which the graphic elements representing the stitch, or seams, may be displayed to the user.

The user wishes the actual seam that is sewn upon the fabric to look like the stitches selected. During a sewing operation, the fabric is moved across the stitch plate and beneath the reciprocating needle by a feed dog. The feeding of the fabric beneath the sewing needle is critical to achieve the intended stitch size and shape. The feed dog is driven by a feeding mechanism which is synchronized with the needle movement. Many factors effect the actual movement of the fabric relative to the movement of the feed dog. Feeding errors commonly occur in the form of slippage or uneven movement between the feed dog and fabric. The type and magnitude of feeding error is dependent upon many factors. The end result of all feeding errors in passing the fabric beneath the needle results in stitches or seams that are misshapen, or of improper size, and that are not what the user intended.

Due to the problems above in the feeding of fabric to achieve an expected and consistent seam, it would be advantageous to provide an algorithm and method to predict and compensate for feeding errors. Such an algorithm and method would provide for modified feeder movement to achieve the required fabric positioning during the sewing operation. The algorithm and method would insure a consistent stitch size over a variety of fabrics, threads, and operating conditions. It is thus to such a feeder movement compensation algorithm and method that the present invention is primarily directed.

SUMMARY OF THE INVENTION

The disadvantages of the prior art are overcome by the present invention which, in one aspect, is a feeder movement compensation algorithm for use within a sewing machine. The sewing machine configured with a reciprocating needle and thread, and including a stitch plate upon which fabric to be sewn is positioned beneath the needle and thread. The machine also includes a feeder mechanism driving a feed dog thru a movement. The feed dog movement pushes the fabric along the stitch plate and the reciprocating needle and thread form stitches in the fabric.

The compensation algorithm includes the sewing machine having a stitch cycle wherein, the needle and thread pierce the fabric to be sewn. The needle then retracts leaving the thread piercing the fabric. The fabric is then moved along the stitch plate by the feed dog movement to a new position beneath the needle, thereby completing the stitch cycle. During the stitch cycle, the feed dog movement completes at least one feeder stroke. The feeder stroke includes a portion of the feed dog extending above the stitch plate and moving along the direction of feed. The feeder stroke thus pushes the fabric along the stitch plate.

The feeder stroke includes a feeder stroke length, a feeder stroke height, and a feeder stroke path. The compensation algorithm calculates a theoretical feeder stroke length based upon a desired stitch. The compensation algorithm then calculates a modified feeder stroke length using the theoretical feeder stroke length and at least one feeder calibration data element. The modified feeder stroke length is then performed by the feed dog during the stitch cycle to form the stitch.

In another aspect of the present invention, the feeder calibration data element includes an operator input data element. The operator input date element including at least one of; a stitch selection, the feed dog type, a presser foot type, a presser foot pressure, a desired speed of feeding, the feeding direction, the type of needle, the needle geometry, the type of fabric, the weight of fabric, the type of thread, the weight of thread, the age of the machine.

In yet another aspect of the present invention, the feeder calibration data element includes a machine measured data element. The machine measured data element including at least one of; a temperature, a thread tension, the feeder mechanism torque, a needle mechanism torque; the feeder mechanism speed, a presser foot type, a presser foot pressure, a presser foot height, a time of operation of the machine, an optical measurement.

In yet another aspect of the present invention, the feeder calibration data element includes a memory stored data element. The memory stored data element including feeding error data relative to at least one of; the feed dog type, presser foot type, a presser foot pressure, feeding speed, feeding direction, needle type, needle geometry, fabric type, fabric weight, thread type, thread weight, machine age.

In yet another aspect of the present invention, the feeder calibration data element includes a memory stored data element. The memory stored data element including feeding error data relative to at least one of; the ambient temperature, thread tension, feeder mechanism power, needle mechanism power; feeder mechanism speed, presser foot pressure, a time of operation of the machine, forward vs. reverse feed balance.

In yet another aspect of the present invention, a plurality of stitches are performed to form a seam. The compensation algorithm calculates a first modified feeder stroke length for one or more discrete stitches within the seam. The compensation algorithm calculates a second modified feeder stroke length for the remaining stitches within the seam.

In yet another aspect of the present invention, the compensation algorithm calculates a modified feeder stroke height using the theoretical feeder stroke length and at least one feeder calibration data element. A memory stored data element includes feeder calibration data relative to feeder stroke height. The modified feeder stroke height is then performed by the feed dog during the stitch cycle to form the stitch.

In yet another aspect of the present invention, the compensation algorithm calculates a modified feeder stroke path using the theoretical feeder stroke length and at least one feeder calibration data element. A memory stored data element includes feeder calibration data relative to feeder stroke path. The modified feeder stroke path is then performed by the feed dog during the stitch cycle to form the stitch.

In yet another aspect of the present invention, a method of feeder movement compensation for use within a sewing machine is presented. The sewing machine configured with a reciprocating needle and thread, and including a stitch plate upon which fabric to be sewn is positioned beneath the needle and thread. The machine also includes a feeder mechanism driving a feed dog thru a movement. The feed dog movement pushes the fabric along the stitch plate and the reciprocating needle and thread form stitches in the fabric.

The compensation algorithm includes the sewing machine having a stitch cycle wherein, the needle and thread pierce the fabric to be sewn. The needle then retracts leaving the thread piercing the fabric. The fabric is then moved along the stitch plate by the feed dog movement to a new position beneath the needle, thereby completing the stitch cycle. During the stitch cycle, the feed dog movement completes at least one feeder stroke. The feeder stroke includes a portion of the feed dog extending above the stitch plate and moving along the direction of feed. The feeder stroke thus pushes the fabric along the stitch plate.

The feeder stroke includes a feeder stroke length, a feeder stroke height, and a feeder stroke path. The compensation algorithm includes the step of calculating the theoretical feeder stroke length based upon a desired stitch. The compensation algorithm also includes the step of calculating a modified feeder stroke length using the theoretical feeder stroke length and at least one feeder calibration data element. The modified feeder stroke length is then performed by the feed dog during the stitch cycle to form the stitch.

In yet another aspect of the present invention, the feeder calibration data element includes an operator input data element. The operator input data element including at least one of; a stitch selection, the feed dog type, a presser foot type, a presser foot pressure, a desired speed of feeding, the feeding direction, the type of needle, the needle geometry, the type of fabric, the weight of fabric, the type of thread, the weight of thread, the age of the machine.

In yet another aspect of the present invention, the feeder calibration data element includes a machine measured data element. The machine measured data element including at least one of; a temperature, a thread tension, the feeder mechanism torque, a needle mechanism torque; the feeder mechanism speed, a presser foot type, a presser foot pressure, a presser foot height, a time of operation of the machine, an optical measurement.

In yet another aspect of the present invention, the feeder calibration data element includes a memory stored data element. The memory stored data element including feeding error data relative to at least one of; the feed dog type, presser foot type, a presser foot pressure, feeding speed, feeding direction, needle type, needle geometry, fabric type, fabric weight, thread type, thread weight, machine age.

In yet another aspect of the present invention, the feeder calibration data element includes a memory stored data element. The memory stored data element including feeding error data relative to at least one of; the ambient temperature, thread tension, feeder mechanism power, needle mechanism power; feeder mechanism speed, presser foot pressure, a time of operation of the machine, forward vs. reverse feed balance.

In yet another aspect of the present invention, a plurality of stitches are performed to form a seam. The step of the compensation algorithm calculating a modified feeder stroke length includes the step of calculating a first modified feeder stroke length for one or more discrete stitches within the seam, and the step of calculating a second modified feeder stroke length for the remaining stitches within the seam.

In yet another aspect of the present invention, the compensation algorithm includes the step of calculating a modified feeder stroke height. The modified feeder stroke height calculated using the theoretical feeder stroke length and at least one feeder calibration data element. The memory stored data element includes feeder calibration data relative to feeder stroke height. And the step of forming a stitch includes performing the modified feeder stroke height.

In yet another aspect of the present invention, the compensation algorithm calculates a modified feeder stroke path. The modified feeder stroke path calculated using the theoretical feeder stroke length and at least one feeder calibration data element. The memory stored data element includes feeder calibration data relative to a feeder stroke path. And the step of forming a stitch includes performing the modified feeder stroke path.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

The algorithm and method for feeder movement compensation calculates and then compensates for feeding errors to achieve the desired seam. The algorithm and method provides for modified feeder movement to achieve the required fabric positioning during the sewing operation. The feeder movement compensation results in the desired stitch size over a variety of fabrics, threads, and operating conditions.

Figure 1:
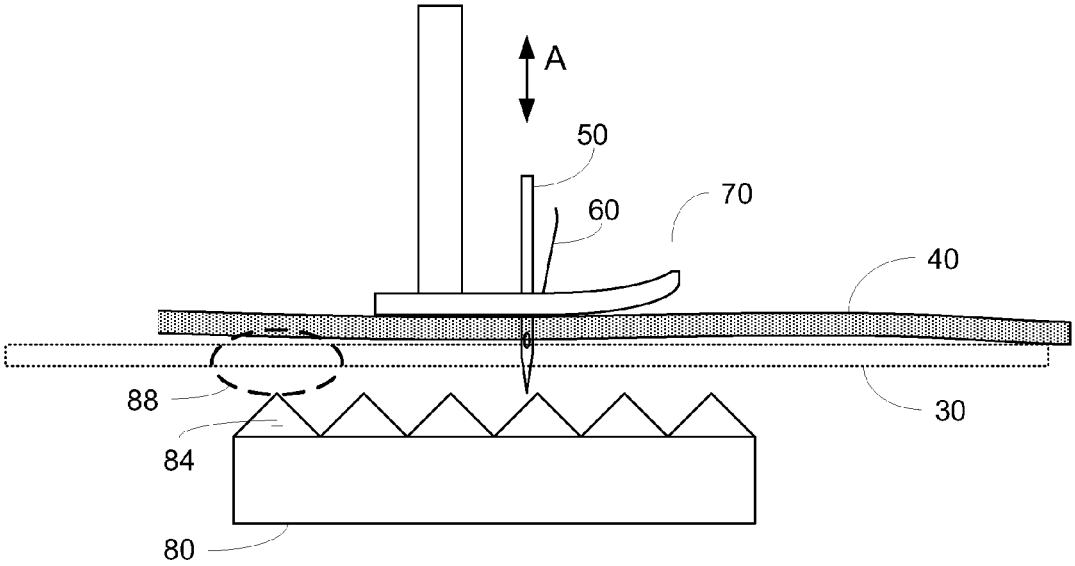
FIG. 1 is a side view of sewing machine head with feeder mechanism.

With reference to the figures in which like numerals represent like elements throughout, FIG. 1 is side view of a common sewing machine head with feeder mechanism. As depicted in FIG. 1, the sewing machine 10 has a stitch plate 30 which supports the fabric 40 to be sewn. A needle 50 is mounted within the sewing machine and during a sewing operation reciprocates up and down in the direction of Arrow "A". The needle carries a thread 60 for creating stitches in the fabric 40. A presser foot 70 is positioned above the stitch plate 30 and presses the fabric 40 onto the stitch plate 30. A feed dog 80 is depicted below the stitch plate 30 and is driven by a feeder mechanism for movement relative to the stitch plate 30. The feed dog 80 has multiple serrations or teeth 84 which are designed to engage the underside of the fabric 40. During a sewing operation, each feed dog tooth 84 moves around a curvilinear path 88 to move or feed the fabric 40 to a new position beneath the needle 50. A representative curvilinear path 88 is depicted as dashed lines in FIG. 1 for the first tooth of the feed dog 80. As will be appreciated by those skilled in the art, during the sewing operation the presser foot 70 is always in contact with the fabric. As depicted in FIGS. 1-9, the presser foot may be shown slightly above the fabric for clarity of the stitch being formed.

Figure 2:
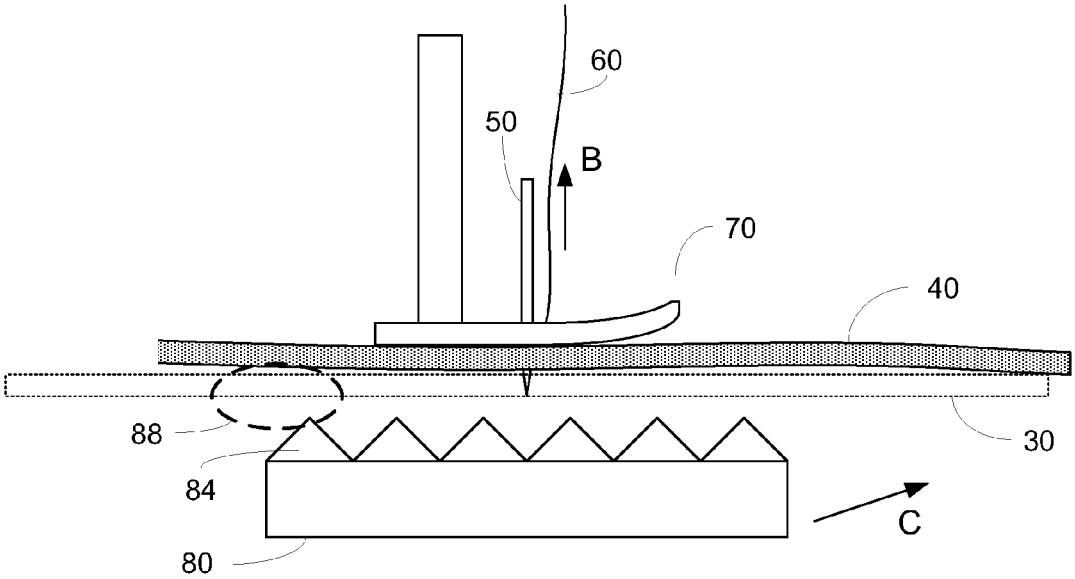
FIG. 2 is a side view of the sewing machine head of FIG. 1 starting a stitch.

FIG. 2 depicts the start of a sewing operation. The fabric 40 is supported by the stitch plate 30 as the needle 50 pierces it. The needle 50 passes into an opening within the stitch plate 30 and does not contact the stitch plate. The needle 50 and thread 60 have pierced the fabric 40 and the needle is moving upward in the direction of Arrow "B". As further depicted in FIG. 2, the feed dog 80 moves up and to the right in the direction of Arrow "C".

Figure 3:
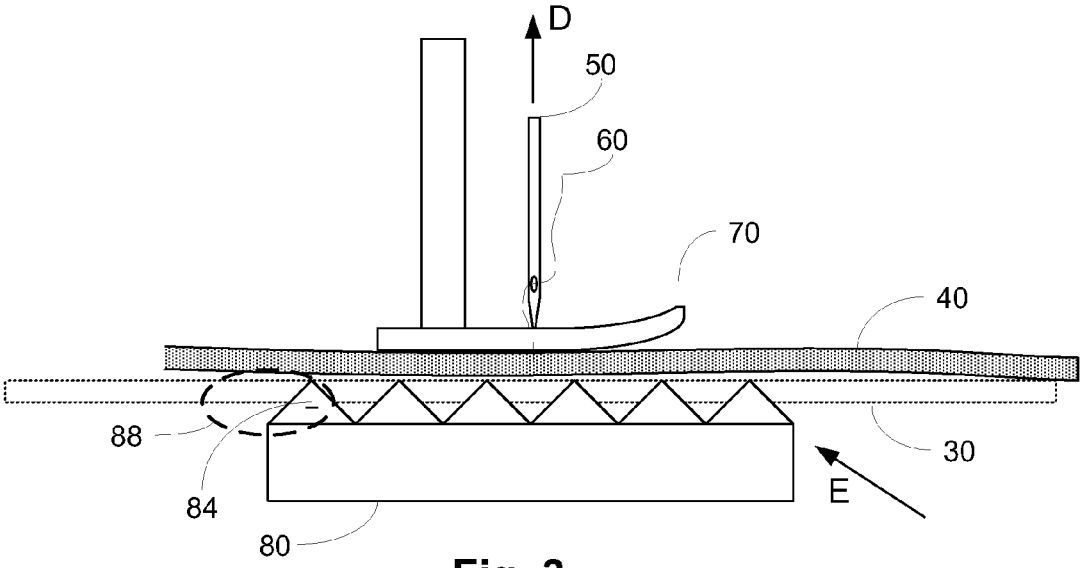
FIG. 3 is a side view of the sewing machine head of FIG. 1 with the feeder mechanism rising above the stitch plate.

As depicted in FIG. 3, the needle retracts from the fabric in the direction of Arrow "D" leaving the thread embedded within the fabric. The feed dog 80 moves up and to the left in the direction of Arrow "E" and begins to protrude over the upper surface of the stitch plate 30.

Figure 4:
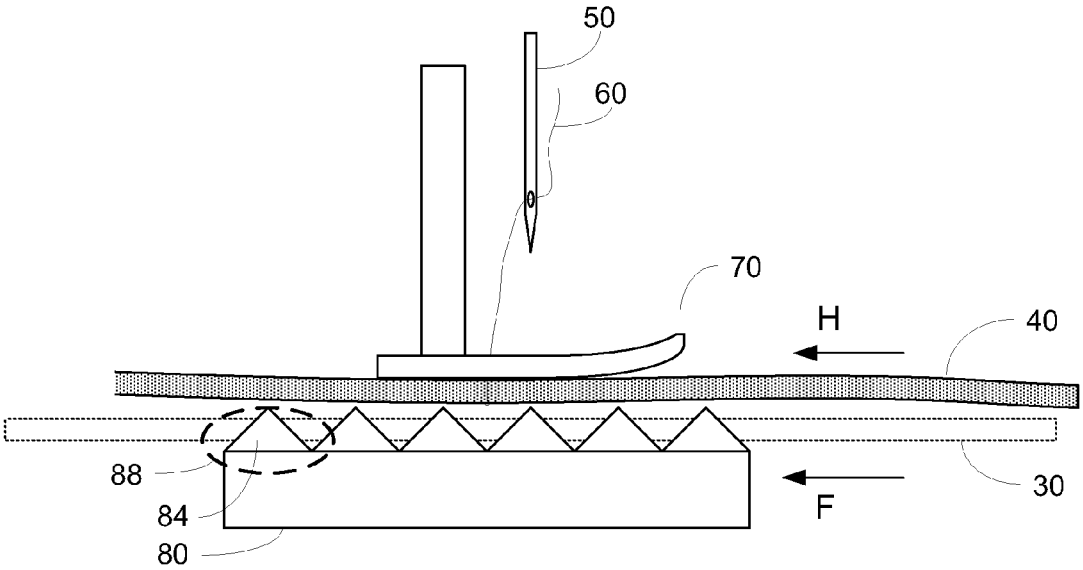
FIG. 4 is a side view of the sewing machine head of FIG. 1 with the feeder mechanism and fabric moving across the stitch plate.

As depicted in FIG. 4, the needle is fully refracted and the feed dog 80 extends above the stitch plate 30 and moves in the direction of Arrow "F". The teeth 84 of the feed dog 80 contact the underside of the fabric 40 and move the fabric in the direction of Arrow "H".

Figure 5:
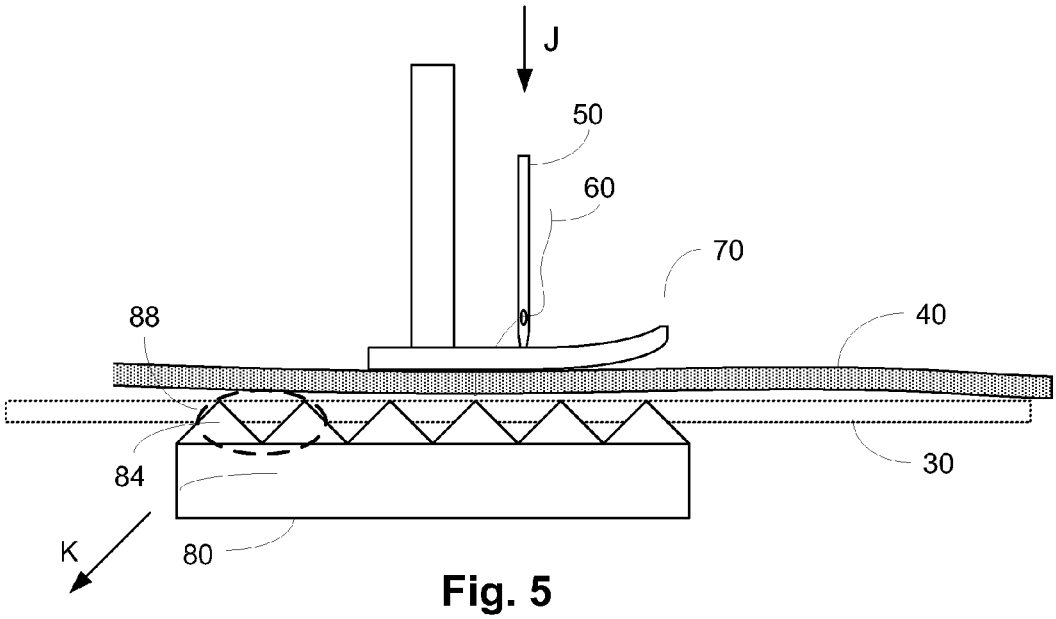
FIG. 5 is a side view of the sewing machine head of FIG. 1 with the feeder mechanism dropping below the stitch plate.

As depicted in FIG. 5, the feed dog 80 moves down and to the left in the direction of Arrow "K" and drops below the upper surface of the stitch plate 30. The needle is moving downward in the direction of Arrow "J". The fabric 30 is now in position to be pierced by the needle to form a new stitch in the seam. The feeder motion of FIGS. 3, 4, and 5, wherein the feed dog extends above the stitch plate 30, moves in the feed direction, and then drops below the stitch plate is defined as a feeder stroke. The feeder stroke therefore having a curvilinear path over the stitch plate 30.

Figure 6:
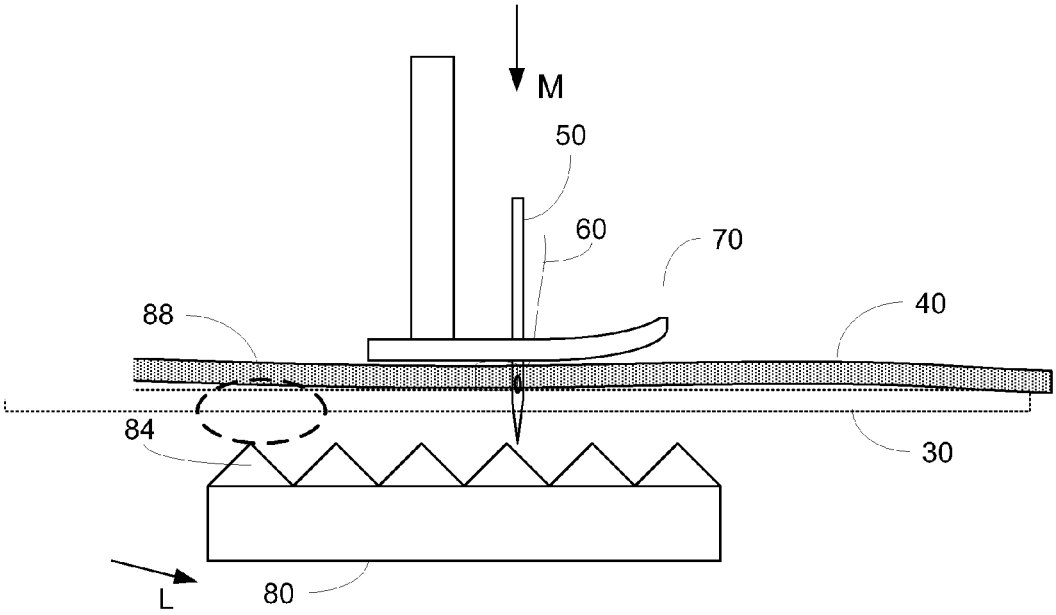
FIG. 6 is a side view of the sewing machine head of FIG. 1 completing a first stitch.
Figure 7:
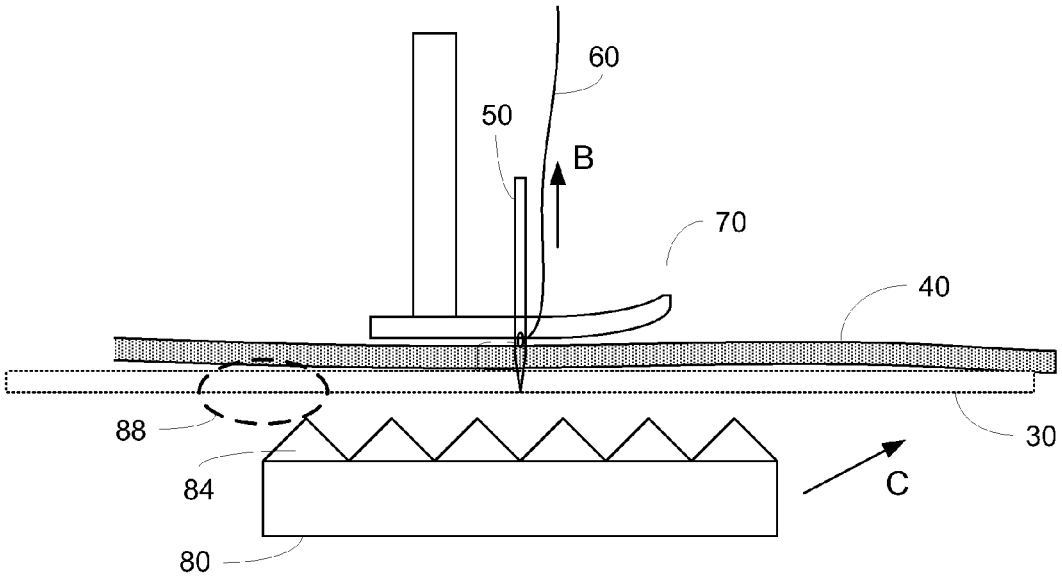
FIG. 7 is a side view of the sewing machine head of FIG. 1 starting a second stitch.
Figure 8:
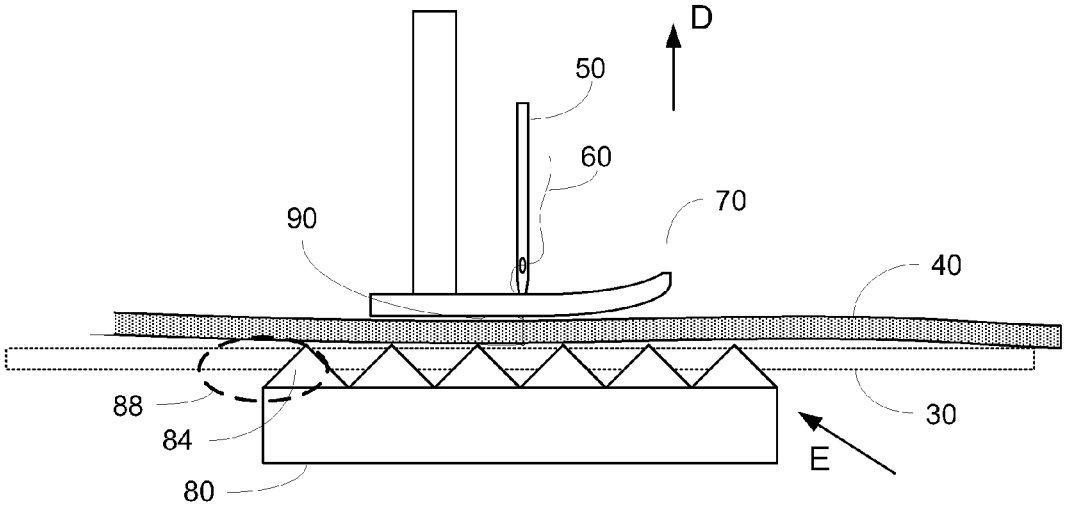
FIG. 8 is a side view of the sewing machine head of FIG. 1 with the feeder mechanism rising above the stitch plate.

As depicted in FIG. 6, the needle 50 has plunged through the fabric 40 in the direction of Arrow "M". A stitch 90 has been formed through the fabric and a stitch cycle has been completed by the machine. The feed dog 80 moves down and to the right in the direction of Arrow "L" below the stitch plate 30.

As depicted in FIG. 7, the needle 50 has again begun moving upward in the direction of Arrow "B" leaving the thread 60 embedded within the fabric 30. The feed dog 80 again moves up and to the right in the direction of Arrow "C".

As depicted in FIG. 8, the needle again retracts from the fabric in the direction of Arrow "D". The feed dog 80 moves up and to the left in the direction of Arrow "E" and begins to protrude over the upper surface of the stitch plate 30. The sewing machine will now proceed thru the motions of FIGS. 4, 5, and 6 to complete the second stitch in the seam.

Figure 9:
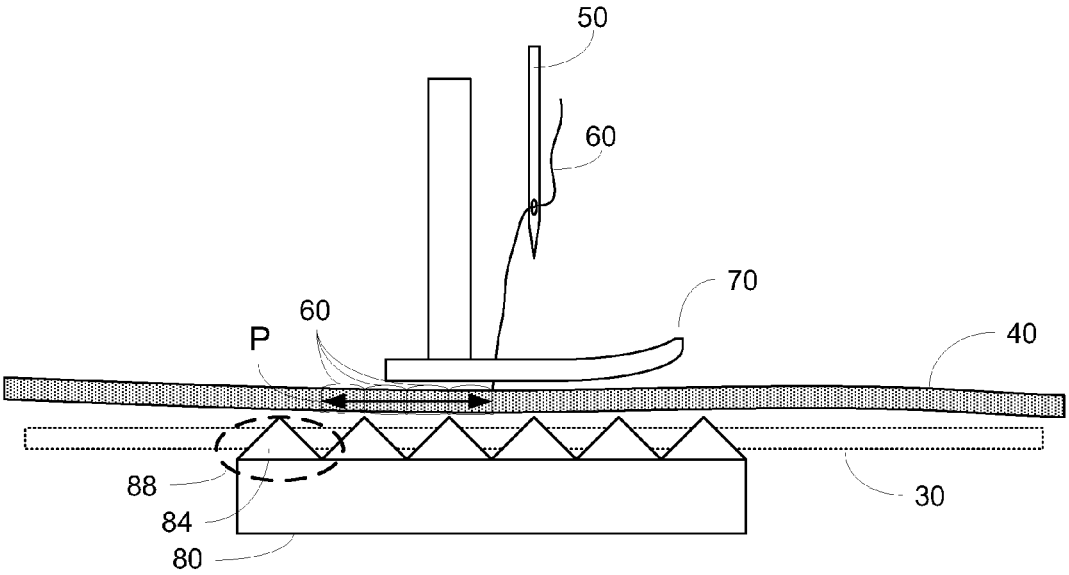
FIG. 9 is a side view of the sewing machine head of FIG. 1 completing a seam.

As depicted in FIG. 9, a total of four stitches 60 have been completed within the fabric 40 to form a seam. The seam has a total length represented by Dimension "P".

Figure 10:
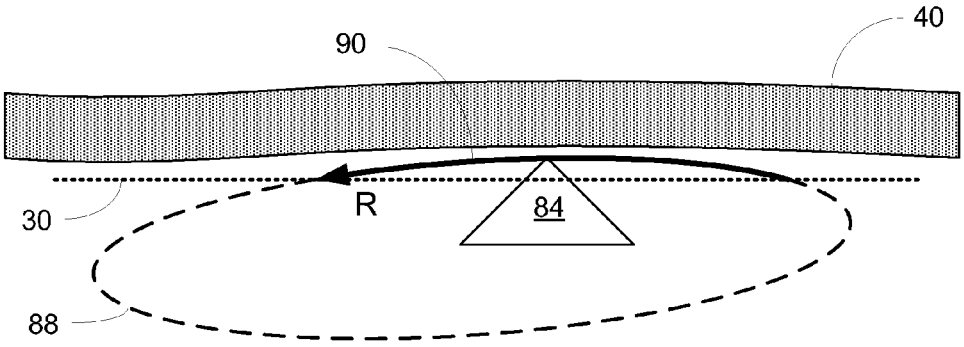
FIG. 10 is a side view of the sewing machine head of FIG. 1 depicting the feeder stroke path of one tooth of the feed dog.
Figure 11:
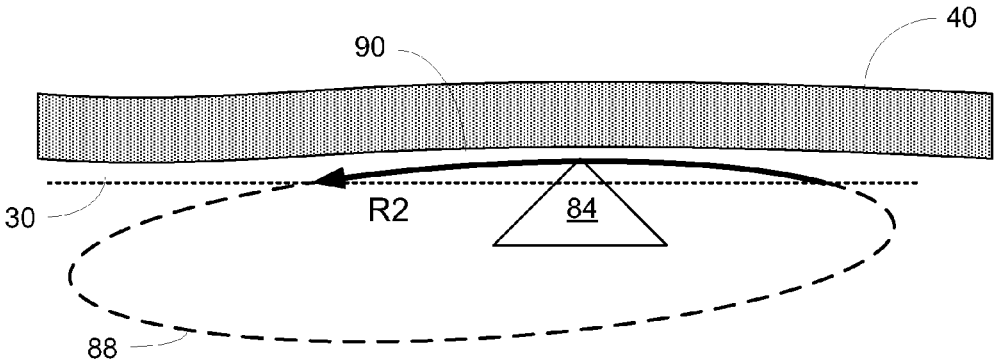
FIG. 11 is a side view of the sewing machine head of FIG. 1 depicting a modified feeder stroke path of one tooth of the feed dog.

As depicted in FIG. 10, the feeder mechanism of the sewing machine moves the feed dog such that a representative tooth 84 moves through a curvilinear path of motion depicted as dashed curve 88. The portion of the curvilinear path 88 which extends above the stitch plate 30 is defined as the feeder stroke path 90 and is shown pictorially as solid curve "R". The feeder stroke "R" having a feeder stroke length, and having a maximum height above the top of the stitch plate called the feeder stroke height. As depicted in FIG. 11, the feeder mechanism of the sewing machine allows changing the path of motion of the feed dog from that forming the feeder stroke R to a modified feeder stroke length R2. The horizontal component of the feeder stroke path 90 is called the feeder stroke length. The length of fabric fed beneath the needle with each feeder stroke may be controlled by the feeder stroke length. The ability to control the fabric feed rate allows the sewing machine to create different stitch lengths. The feeder stroke length may be changed dynamically during operation of the machine and the feeder stroke length used for individual stitches may be different within a seam. As will be appreciated by those skilled in the art, the elliptical path shown in FIGS. 10 and 11 is an idealized geometry. In practice, the feeder movement curve is a series of tangential arcs and the feeder curve may have sections of straight line, or very nearly straight line movement.

Figure 12:
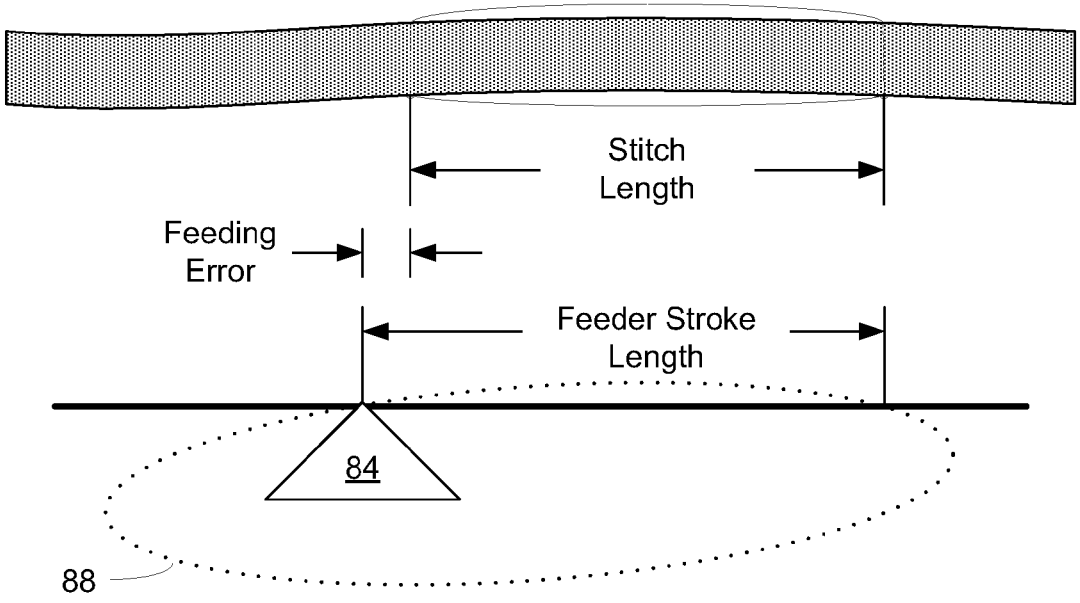
FIG. 12 is a side view of the sewing machine head of FIG. 1 depicting an actual feeding length vs the feeder stroke length.

As depicted in FIG. 12, for any desired seam, a feeder stroke length may be calculated. However in operation, the actual length of fabric fed beneath the needle between stitches is not the same as the feeder stroke length. As used herein, feeding length and stitch length have the same meaning. The difference between the feeder stroke length and the actual stitch length may be defined as the feeding error. The actual stitch length may also be called the practical stitch length. One of the reasons for not feeding the same stitch length as the feeder stroke length is that the geometry of the feeder stroke is oval. Creating a mechanically rectangular feeder movement results in better practical stitch length, but the mechanism for created such feeder movement is more complicated and more noisy in operation. Other factors contributing to feeder error are the tolerances and wear within the feeder mechanism, the height the feeder mechanism extends above the stitch plate, and the actual feeder stroke path that results from the feeder mechanism geometry.

Many factors affect the feeder stroke length vs actual stitch or feeding length; the speed with which the fabric is fed by the feeder, the temperature of the fabric and feeder mechanism, the weight of the fabric per unit area, the thickness of the fabric, the stiffness of the fabric, the thread count of the fabric, the weight of the thread per inch, the stiffness of the thread, and the diameter of the thread. For example, a thick canvas fabric will behave differently than a sheer cotton fabric. Stated another way, the amount of fabric moved beneath the needle for a given feeder stroke length for a thick canvas fabric will be different than that of the sheer cotton. The canvas and cotton fabrics each have a different density, stiffness, friction with the feeder and stitch plate, and a differing thread tension during the sewing cycle.

The number and configuration of feed teeth on the feeder will result in different feeding lengths. A feeder configuration may exhibit a more idealized feed length with some fabrics than with others. Yet another variable may be the total time which the sewing machine has been in operation. The feeder mechanism may wear over time resulting in a change in actual stitch length when compared to the feeder stroke length.

Another variable that may affect the feeder stroke length vs the actual feeding length is the presser foot design and pressure. Different models of presser feet in combinations with the variables above may result in different actual feed lengths. The pressure which the presser foot exerts upon the fabric surface will also affect the feeding. As yet another variable, a machine may be equipped with dual feeding, i.e. a top feeder may be added, or a machine may only use top feeding.

Figure 13:
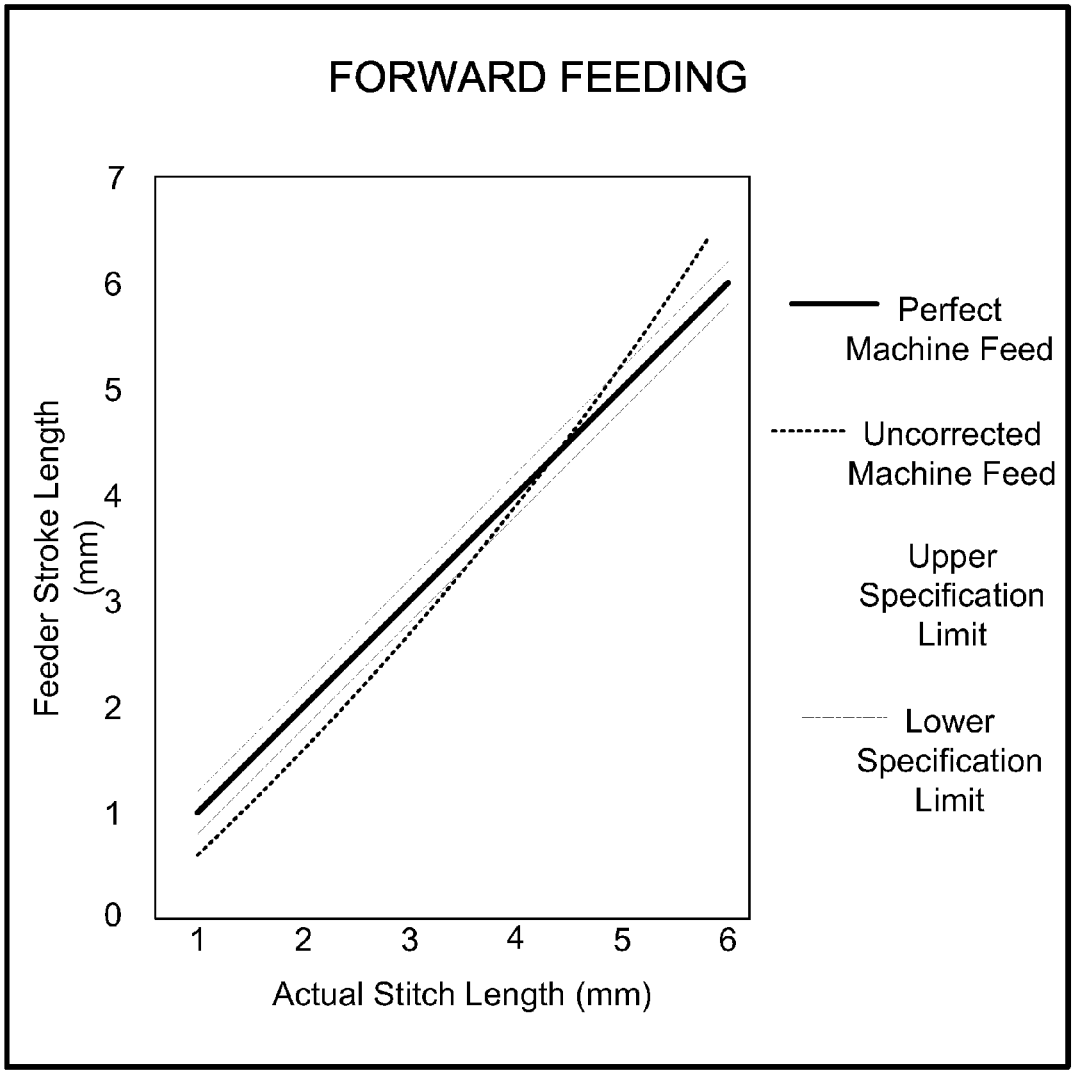
FIG. 13 is an example plot of actual feeding length vs the feeder stroke length.

One example dataset of the actual feeding length vs the feeder stroke length is plotted in the diagram of FIG. 13. In FIG. 13, forward feeding is shown, but a similar feeding error will occur in reverse feeding. The first curve shows an example of a machine combination exhibiting perfect feed were the feeder stroke length and actual feed length are always the same. The second curve shows an example sewing machine with uncorrected feeding error. The third and fourth curves shows practical upper and lower specification limits on the feeding error. As be seen FIG. 13, the actual feeding length may be greater than, or less than, the feeder stroke length.

In one embodiment of present invention, to compensate for the feeding error within the sewing machine processor, the sewing machine designer must gather knowledge of the error over the various operating and configuration variables encountered. The knowledge may be called feeder calibration data. The feeding error for a given set of configuration and operating variables is found by feeding with a theoretical feeder stroke length (tl) and then measuring the practical feeding length (pl). The theoretical feeder stroke length is calculated assuming perfect feed during the feeder stroke wherein the fabric movement along the stitch plate will be equal to the feeder stroke length. The feeding error (fe) is then equal to the difference in the theoretical feeder stroke length and the practical length. fe=tl−pl (mm).

As will be appreciated by those skilled in the art, the feeder mechanism is commonly driven with a stepper motor having a finite number of steps per revolution. With knowledge of the feeder mechanism, the feeder stroke length resulting from each rotational step of the stepper motor is known. By knowing the feeder stroke per step resolution X (mm/step) it is possible to calculate the number of steps that should be used for a given theoretical feeder stroke length tl. The theoretical stroke length divided by the feeder stroke per step resolution X will yield the number of steps that should be used to feed tl mm. N=tl/X However, with knowledge of the feeding error fe, to achieve the desired practical feed length, only (tl+fe)/X steps shall be used. As will be appreciated by those skilled in the art, other drive components may be used within the feeder mechanism such as linear actuators, rotary actuators, electric motors of all types, and encoders.

As one Example: the theoretical feeder stroke length is initially calculated to be 6 mm for a desired seam. tl=6 mm The measured practical stitch length that results from this feeder stroke is 6.3 mm. pl=6.3 mm Therefore the feeding error fe=tl−pl gives fe=6−6.3 mm=−0.3 mm feeding error. The feeder stroke per step resolution of the device is X=0.1 mm/step. To achieve the desired stitch length, the machine should use a modified feeder stroke length of (tl+fe)/X=(6+(−0.3))/0.1=57 steps. Without knowledge of the feeder error, 60 steps of rotation would have been used resulting in stitches 6.3 mm long.

In another embodiment of the present invention, by predicting the feeding error for a given set of variables we may compensate for the feeding error across the whole seam. This is far superior when compared to correcting the stitch length at some localized stitch along the seam. When the seam desired does not result in a whole number of steps of the stepper motor per stitch, successive stitches within the seam may use a different number of steps to achieve the desired average stitch length. Referencing the example above, if the feed error is −0.25 mm. The feeder drive would then need a modified feeder stroke length of 57.5 steps. Incremental steps are difficult with a stepper motor drive mechanism. The machine processor will instead use 57 steps, then 58 steps, for successive stitches along the seam.

In another embodiment of the present invention, to obtain feeder calibration data for a given configuration, the first thing is to balance the machine mechanically by adjusting the machine so that for a certain stitch length, for example 3 mm, the forward and the backward feeder stroke lengths are exactly the same. The next step is to create an arbitrary number of seams that are sewn forward and reverse with a predefined fabric, thread, needle, presser foot and speed. The seams consist of Y stitches where all stitches have the same length within the seam. The seams to be sewn are presented in Table 1, and Table II presents the resulting forward and reverse feed errors.

TABLE I

| Seam | Stitch length | Number stitches | Seam length |
|---|---|---|---|
| 1 | 1 mm | 60 | 60 mm |
| 2 | 3 mm | 20 | 60 mm |
| 3 | 6 mm | 10 | 60 mm |

TABLE II

| Seam | Forward seam length | Forward fe | Reverse seam length | Reverse fe |
|---|---|---|---|---|
| 1 | 58 mm | 2 mm | 55 mm | 5 mm |
| 2 | 59 mm | 1 mm | 58 mm | 2 mm |
| 3 | 66 mm | −6 mm | 63 mm | −3 mm |

The feeder calibration data of Tables I and II is then stored within the machine memory. During machine operation, the feeding errors are used as input in a feed compensation algorithm executed as part of the machine control program by the machine processor to calculate a modified feeder stroke length.

In another embodiment of the present invention, feeder calibration data may be obtained for any of the configurations and variables identified above for use in the feed compensation algorithm. Some variables above may be studied singularly, and their individual effect on feeding error measured. The effect of other variables may be measured as a group, and the feeding error correction for the group of variables used in the compensation algorithm.

In another embodiment of the present invention, the feeder calibration data used within the feed compensation algorithm will be at least one of three types; data input by the machine operator, data as measured by the sewing machine processor, or data as input by the machine manufacturer and stored in the machine memory. Examples of data input by the machine operator or user may include; a stitch selection, the feed dog type, a presser foot type, a presser foot pressure, a desired speed of feeding, the feeding direction, the type of needle, the needle geometry, the type of fabric, the weight of fabric, the type of thread, the weight of thread, the age of the machine. In one embodiment, the operator may input the weight and type of fabric being sewn. The feed compensation algorithm may then use memory stored data to obtain feeder calibration data associated with the type and weight of fabric.

In another embodiment, examples of data as measured by the sewing machine processor, also referred to herein as machine measured data, may include; a temperature, a thread tension, the feeder mechanism torque, a needle mechanism torque; the feeder mechanism speed, a presser foot type, a presser foot pressure, a presser foot height, a time of operation of the machine, an optical measurement. In one embodiment, the processor may measure the feeder mechanism current and voltage to determine the power being drawn by the feeder mechanism during the sewing cycle. The measured power may then be used with memory stored data within the feed compensation algorithm. In another embodiment, an optical sensor may be utilized to interrogate the stitches as they are created. The processor may then use the optical data within the feed compensation algorithm.

In yet another embodiment of the present invention, examples of memory stored data may include feeder calibration data relative to; the feed dog type, presser foot type, a presser foot pressure, feeding speed, feeding direction, needle type, needle geometry, fabric type, fabric weight, thread type, thread weight, machine age, the ambient temperature, thread tension, feeder mechanism power, needle mechanism power; feeder mechanism speed, presser foot pressure, a time of operation of the machine, forward vs. reverse feed balance.

As will be appreciated by those skilled in the art, multiple data sets may be measured and stored in machine memory to fully quantify and calibrate the machine feed. The data entities above may be stored in memory as tabular data. The compensation algorithm may calculate a curve fit approximation for any of the date elements above. The curve approximation may then be used to estimate compensation values between, or as an extension of, the data points.

In alternative embodiments of the invention, any combination of the variables identified above may be considered by the software and used in the feeding error calculation. The user may input any combination of the operator input data. In one embodiment, the compensation algorithm may approximate the stiffness of the fabric when the user selects the type of fabric and fabric weight from a pull down menu. In another embodiment, the machine may dynamically measure one of the variables above during the sewing operation. For example, the temperature of the ambient air may be measured by the machine and dynamically used in the feed error correction. In another example, the thread tension may be measured by the machine and dynamically used in the feed error correction. A plurality of feeder calibration data may be used by the feed compensation algorithm to calculate the appropriate modified feeder stroke length.

As may be appreciated by those skilled in the art, other feeder mechanisms may be utilized to move the feed dog beneath the fabric. In one alternative embodiment of the invention, the feeder stroke height may be altered by the compensation algorithm based upon feeder calibration data. In another alternative embodiment of the present invention, the feeder mechanism allows the shape of the curvilinear path of the feed dog, or the feeder stroke path, to be altered by the compensation algorithm based upon feeder calibration data.

While there has been shown a preferred embodiment of the present invention, it is to be understood that certain changes may be made in the forms and arrangement of the algorithm and steps of the method for feeder movement compensation without departing from the underlying spirit and scope of the invention.

What is claimed is:

1. A method of stitching using a processor-controlled sewing machine having a feed dog, a stepper motor, and a memory, the method comprising:

activating a stitch length compensation computer program stored in the memory, the stitch length compensation computer program having an algorithm for determining a modified feeder stroke length based upon a calculated modified feeder stroke length, the algorithm having the steps of:

determining a number of stepper motor revolutions required to move the feed dog a theoretical feeder stroke distance corresponding to a desired stitch length;

determining a feeder stroke distance error;

calculating the number of stepper motor revolutions corresponding to the feeder stroke distance error;

calculating a calculated modified feeder stroke distance by modifying the theoretical feeder stroke distance by the feeder stroke distance error;

determining at least one modified feeder stroke length based upon the calculated modified feeder stroke length;

determining the number of stepper motor revolutions corresponding to the at least one modified feeder stroke length;

executing the stitch length compensation computer program to cause the stepper motor to perform the number of revolutions corresponding to the at least one modified feeder stroke length; and forming a stitch of the desired length.

2. The method of claim 1, wherein the feeder stroke distance error is determined from calibration data comprising at least one of an operator-input data component, a machine-measured data component, and a manufacturer-measured data component.

3. The method of claim 2, wherein two modified feeder stroke lengths are calculated from the calculated modified feeder stroke length.

4. The method of claim 3, wherein the sewing program causes a first modified feeder stroke to form a stitch of a first length and causes a second modified feeder stroke length to form a stitch of a second length, where the average length of the first stitch length and the second stitch length equal the desired stitch length.

* * * * *

UNITED STATES PATENT AND TRADEMARK OFFICE

CERTIFICATE OF CORRECTION

PATENT NO. : 8,985,038 B2
APPLICATION NO. : 13/156347
DATED : March 24, 2015
INVENTOR(S) : Anders Flygare et al.

It is certified that error appears in the above-identified patent and that said Letters Patent is hereby corrected as shown below:

In the Specification:

Column 5, Line 42, delete "refracted" and insert -- retracted --.

Signed and Sealed this
Thirtieth Day of June, 2015

Michelle K. Lee

Michelle K. Lee
*Director of the United States Patent and Trademark Office*